US010743601B2

(12) United States Patent
Flack

(10) Patent No.: US 10,743,601 B2
(45) Date of Patent: Aug. 18, 2020

(54) HELMET CHIN STRAP

(71) Applicant: Darryl Rodney Flack, Gladesville (AU)

(72) Inventor: Darryl Rodney Flack, Gladesville (AU)

( * ) Notice: Subject to any disclaimer, the term of this patent is extended or adjusted under 35 U.S.C. 154(b) by 0 days.

(21) Appl. No.: 16/615,415

(22) PCT Filed: May 23, 2018

(86) PCT No.: PCT/AU2018/050497

§ 371 (c)(1),
(2) Date: Nov. 21, 2019

(87) PCT Pub. No.: WO2018/232444

PCT Pub. Date: Dec. 27, 2018

(65) Prior Publication Data

US 2020/0100553 A1 Apr. 2, 2020

(30) Foreign Application Priority Data

Jun. 21, 2017 (AU) ..... 2017902401

(51) Int. Cl.
*A42B 3/08* (2006.01)

(52) U.S. Cl.
CPC ..... *A42B 3/08* (2013.01); *A42B 3/085* (2013.01)

(58) Field of Classification Search
CPC ..... A42B 3/08; A42B 3/085
See application file for complete search history.

(56) References Cited

U.S. PATENT DOCUMENTS 2,867,811 A * 1/1959 Jones ..... A42B 3/08 2/421
3,311,921 A * 4/1967 Helm ..... A63B 71/10 2/421
3,787,895 A 1/1974 Belvedere
4,335,472 A * 6/1982 Rappleyea ..... A42B 3/08 2/421
4,449,275 A * 5/1984 Nava ..... A42B 3/08 24/265 EC
5,077,839 A * 1/1992 Keller ..... A42B 3/08 2/421
5,118,104 A * 6/1992 DeLanzo ..... A63B 69/0002 273/DIG. 17
5,946,735 A * 9/1999 Bayes ..... A42B 3/08 2/421
6,298,483 B1 * 10/2001 Schiebl ..... A42B 3/0433 2/421

(Continued)

FOREIGN PATENT DOCUMENTS

DE 3325250 1/1985
DE 8514219 6/1985
WO 2006089098 8/2006

*Primary Examiner* — Khaled Annis
(74) *Attorney, Agent, or Firm* — Sand, Sebolt & Wernow Co., LPA

(57) ABSTRACT

A chin strap with two axes of support for improved helmet retention. A first portion of the strap passes under the chin as per a conventional chin strap, and a second portion holds a cup on the point of the chin. The two portions of strap are disposed at approximately 55 degrees to each other, thus providing the two axes of support and consequently improved retainment of the helmet on the rider's head when impacted.

15 Claims, 4 Drawing Sheets

(56) References Cited

U.S. PATENT DOCUMENTS

| | | | | |
|---|---|---|---|---|
| 6,381,760 | B1 * | 5/2002 | Lampe | A42B 3/00 2/414 |
| 6,481,024 | B1 * | 11/2002 | Grant | A42B 3/08 2/421 |
| 2004/0003452 | A1 * | 1/2004 | Schiebl | A42B 3/08 2/421 |
| 2009/0107514 | A1 * | 4/2009 | Winningham | A42B 3/08 128/857 |
| 2009/0265841 | A1 * | 10/2009 | Ferrara | A42B 3/08 2/421 |
| 2013/0000016 | A1 | 1/2013 | Hall et al. | |
| 2014/0068843 | A1 * | 3/2014 | Wegener | A42B 3/08 2/421 |
| 2014/0150168 | A1 * | 6/2014 | Erb | A42B 3/08 2/421 |
| 2015/0033457 | A1 * | 2/2015 | Tryner | A42B 3/205 2/421 |
| 2018/0084858 | A1 * | 3/2018 | Schiebl | A42B 3/08 |

* cited by examiner

HELMET CHIN STRAP

FIELD OF THE INVENTION

The present invention relates to a chin strap for use with a helmet.

BACKGROUND TO THE INVENTION

The present invention provides an improved chin strap for use with a helmet. It is primarily aimed for use with motorcycle helmets, both full-face and open-face, and will be discussed in that context, however the chin strap is suitable for use with other types of helmets such as motorsport helmets, military helmets, workplace hard hats, and emergency services helmets.

Prior art helmets are usually retained by a single strap passing under the chin which provides a single axis of support. Such straps perform adequately in static and low impact situations, however when a helmet is subject to a large force away from the single strap axis, such as during a high-speed motorcycle accident, a helmet can often be dislodged with often serious consequences.

To help improve the retention of traditional helmets thin cheek-jaw pads are often used. However, such a method of retention makes a helmet difficult to put on and take off again. This is of particular concern after an accident as it makes helmet removal difficult for emergency service personnel.

The object of this invention is to provide a helmet chin strap with improved retention to alleviate the above problems, or at least provide the public with a useful alternative.

SUMMARY OF THE INVENTION

The invention provides a chin strap for improved retention of a helmet, comprising a slip guide attached to the helmet, a chin cup and a length of webbing, wherein a first portion of the webbing passes from the chin cup to the slip guide and a second portion of the webbing passes from the slip guide to under a chin of a rider.

Preferably the first portion of webbing is disposed to the second portion of webbing at an angle of approximately 55 degrees.

Preferably chin cup is formed with a first arcuate profile from side to side and a second arcuate profile from top to bottom, and includes a relief aperture to allow the chin cup to conform to the rider's chin.

In preference the slip guide is rigidly attached to the helmet.

It should be noted that any one of the aspects mentioned above may include any of the features of any of the other aspects mentioned above and may include any of the features of any of the embodiments described below as appropriate.

BRIEF DESCRIPTION OF THE DRAWINGS

Preferred features, embodiments, and variations of the invention may be discerned from the following Detailed Description which provides sufficient information for those skilled in the art to perform the invention. The Detailed Description is not to be regarded as limiting the scope of the preceding Summary of the Invention in any way. The Detailed Description will make reference to a number of drawings as follows.

Figure 1:
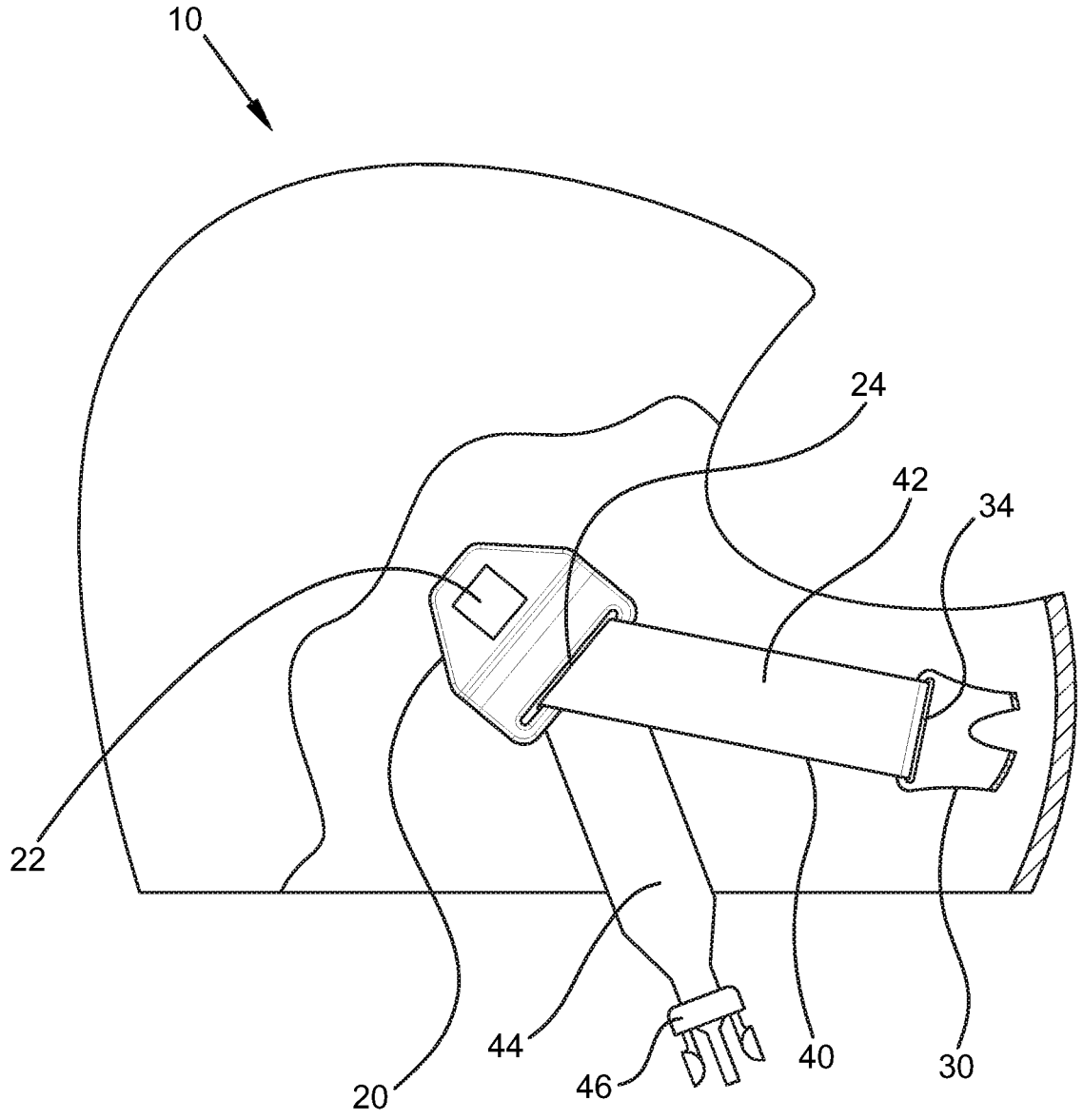
FIG. 1 shows a cutaway view of a helmet showing the chin strap of the present disclosure.

The drawings include the following integers.

10 helmet
20 slip guide
22 mounting bolt
24 strap slot
26 step
30 chin up
32 relief hole
34 strap slot
36 upper portion
38 lower portion
40 strap
42 upper strap portion
44 lower strap portion
46 buckle

DETAILED DESCRIPTION OF THE INVENTION

The following detailed description of the invention refers to the accompanying drawings. Wherever possible, the same reference numbers will be used throughout the drawings and the following description to refer to the same and like parts. Dimensions of certain parts shown in the drawings may have been modified and/or exaggerated for the purposes of clarity or illustration.

The present invention provides an improved chin strap with two axes of support. A first portion of the strap passes under the chin as per a conventional chin strap, and a second portion holds a cup on the point of the chin. The two portions of strap are disposed at an angle of approximately 55 degrees to each other, thus providing the two axes of support and consequently improved retainment of the helmet on the rider's head when impacted.

Figure 2A:
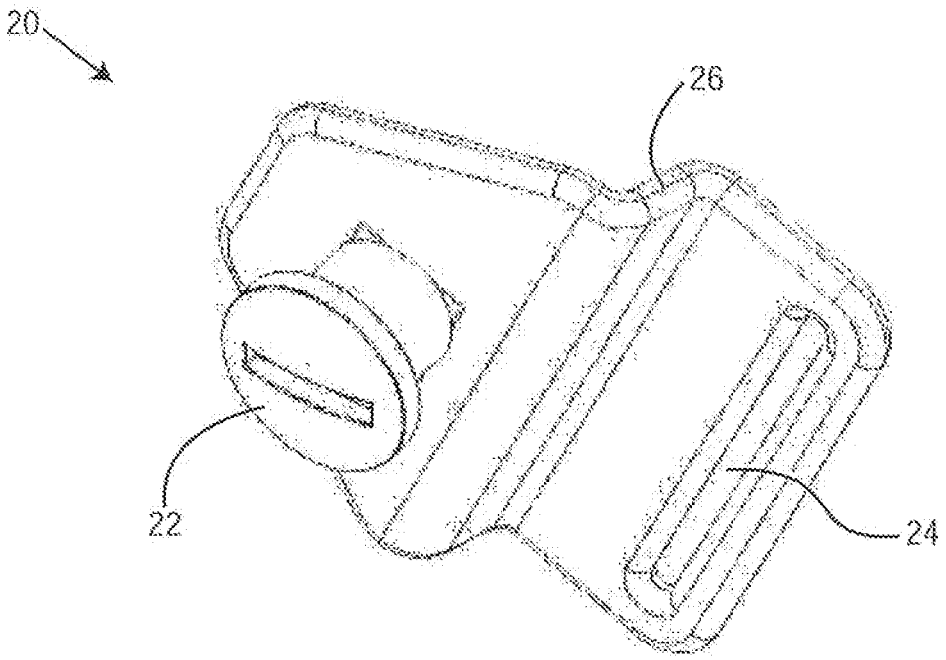
FIGS. 2A and 2B show the slip guide of the chin strap from 2 different perspective views.
Figure 2B:
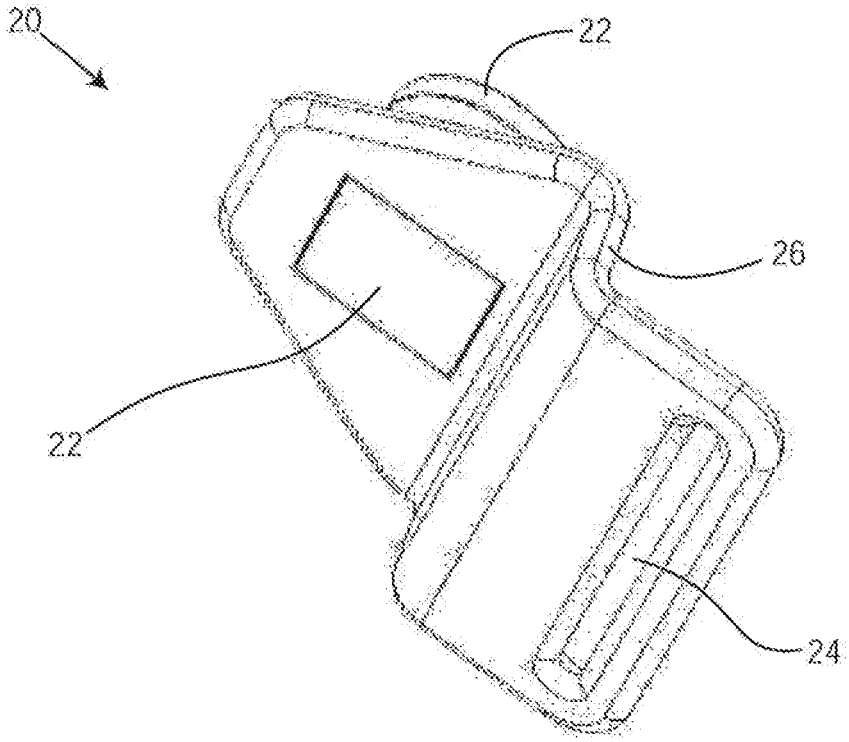
Figure 3A:
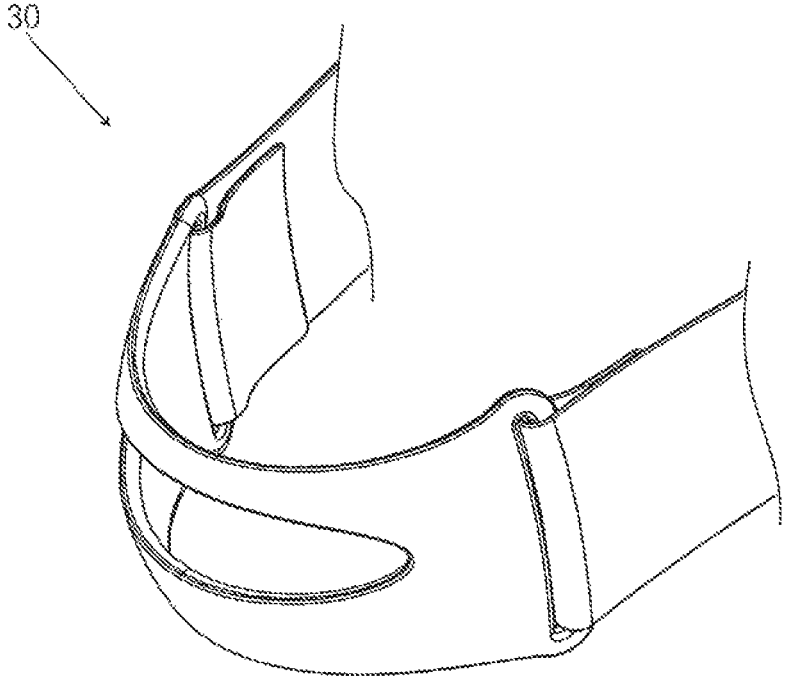
FIGS. 3A and 3B shows the chin cup of the chin strap from perspective and side views respectively.
Figure 3B:
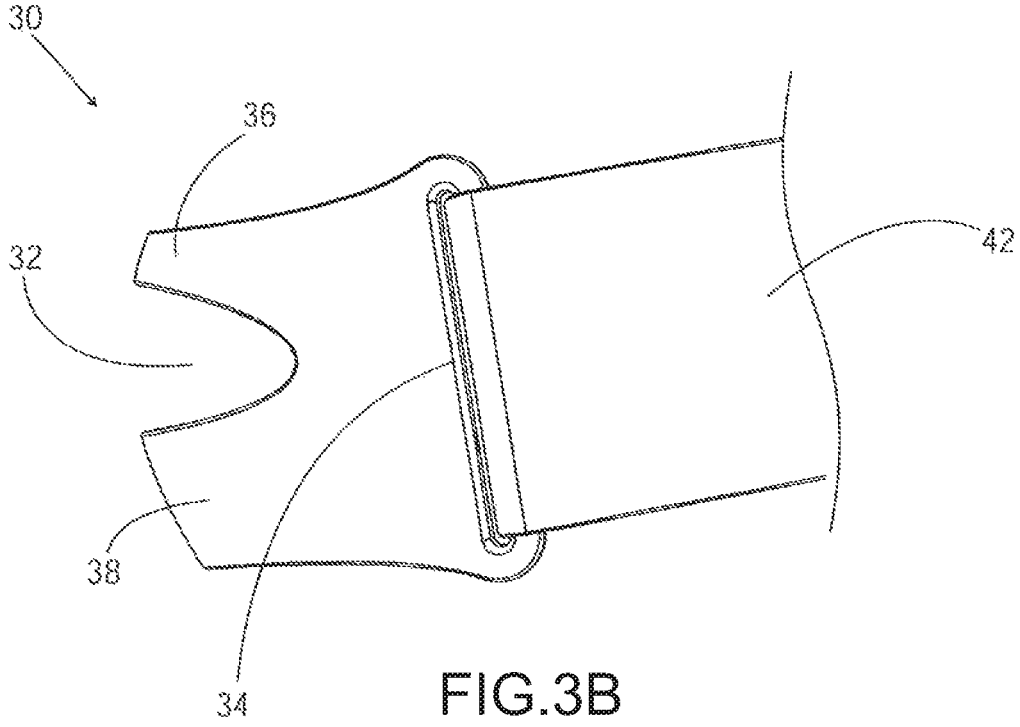

A cutaway view of a helmet 10 incorporating the chin strap of the invention is shown in FIG. 1. The helmet and invention have been cut down the middle and the lining of the helmet has also been removed. The invention comprises three main components; a slip guide 20, a chin cup 30 and a strap 40. The slip guide is shown in detail from front and rear perspective views in FIGS. 2A and 28. The chin cup is shown in perspective and side views in FIGS. 3A and 38.

The slip guide 20 secures the chin strap to the helmet 10 via mounting bolt 20. The bolt includes a square section that sits in a corresponding square section of the slip guide to prevent unwanted pivotal movement of the slip guide when the helmet is subject to an impact force. The slip guide includes a strap slot 24 for guiding the strap 40 and a step 26 to provide clearance between the strap slot and the side of the helmet. The slip guide is preferably moulded from, but not limited to, a semi-rigid plastic such as ABS.

The chin cup 30 is designed to comfortably cradle the point of a riders chin. The overall shape of the chin cup is arcuate from top to bottom and from side to side. The shape together with the relief hole allow the chin cup to conform to most chin shapes, with the upper portion 36 sitting in front of the chin and the lower portion 38 sitting below the chin. The chin cup is preferably moulded from ABS plastic which is suitably flexible and strong, and covered in a thin layer of moisture-absorbent padding to be comfortable on a bare chin. The chin cup is attached to the upper strap portion 42 via strap slots 34.

Figure 4:
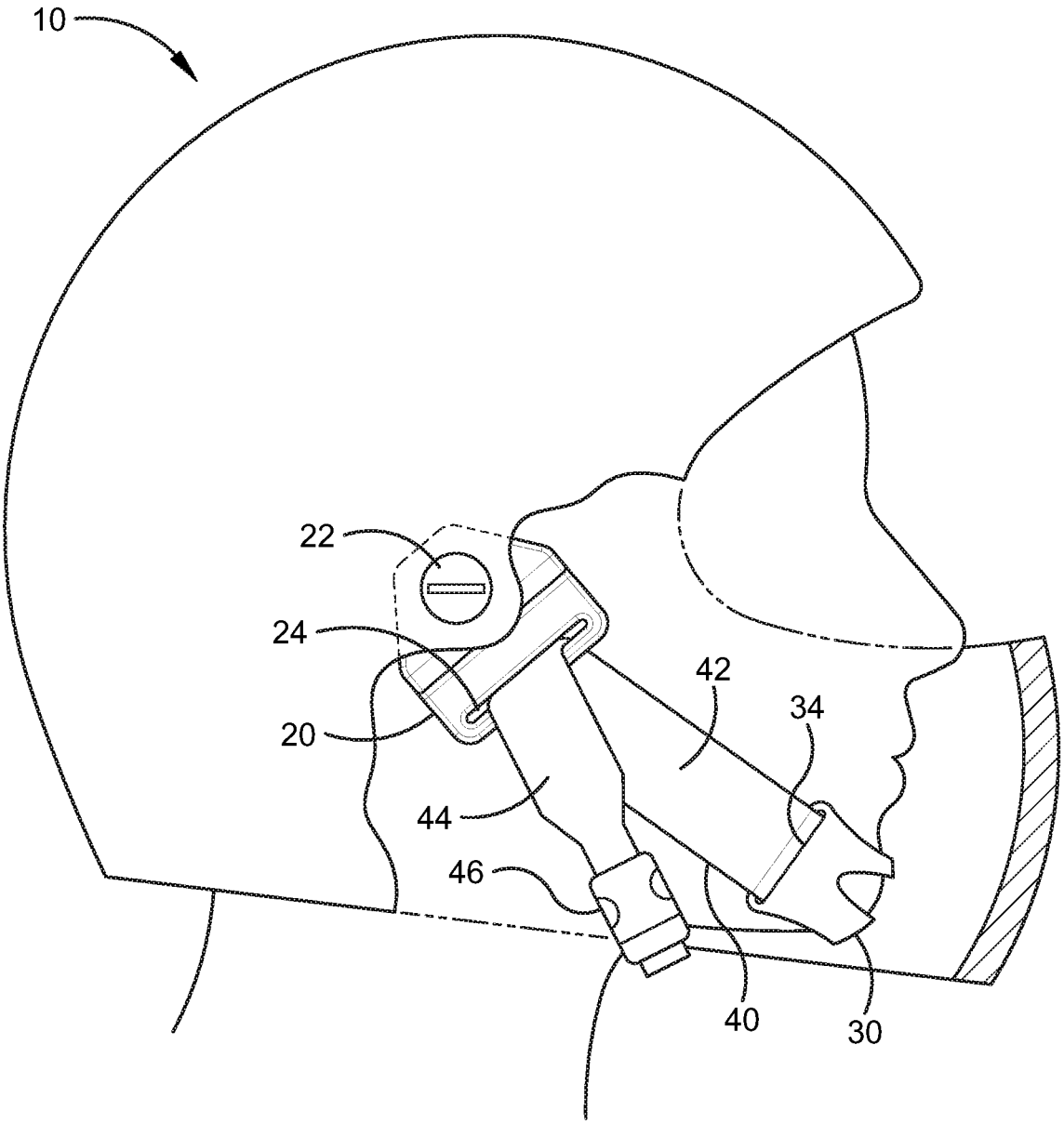
FIG. 4 shows a partial cutaway of the helmet of FIG. 1 worn by a rider and showing the chin cup of the chin strap in accordance with the present disclosure seated on the rider's chin and the second portion of the chin strap webbing secured under the rider's chin by a buckle.

The strap 40 comprises two pieces of webbing (only one of which is shown), each attached at a first end to the chin cup 30 using slot 34, and passing through the slot 24 of the slip guide and then passing under the chin of the rider. The second ends of the webbing are attached together with a conventional buckle 46 (FIG. 4) or D-Clip (not shown), which are both to be secured by the rider. The webbing is approximately 48 mm wide for the portion attached to the chin cup and passing through the slip guide, and then transitions to approximately 15 mm wide for passing under the rider's chin. The wide portion distributes any load evenly across the chin cup whilst the narrow portion is a comfortable width for the rider's chin. The slip guide is attached adjacent to the conventional chin strap anchor point of the helmet and angled so that the strap 40 is effectively divided into an upper portion 42 for the chin cup and a lower portion 44 for passing under the chin. The two sections are disposed at an angle of approximately 55 degrees to each other thereby providing two axes of support for improved retainment of the helmet.

Not shown in the figures is the internal padding of the helmet which is preferably configured to complement the chin strap of the invention. As the invention improves helmet retention, there is scope for reducing the thickness of the cheek padding as it has a diminished secondary role of helmet retention. This makes a helmet easier to put on and take off, which is particularly beneficial after an accident. The preferred padding is formed in two layers with an internal slip sleeve to accommodate the strap 40. Plastic slits to reduce friction are placed in the padding adjacent to the chin strap and the slip guide for the strap to reach those components. Having the strap partially concealed within the padding is more comfortable for the rider and prevents the strap from bunching up as the helmet is put on, and thus makes the helmet easier to remove.

The reader will now appreciate the present invention which provides a chin strap with two axes of support to improve helmet retention.

Further advantages and improvements may very well be made to the present invention without deviating from its scope. Although the invention has been shown and described in what is conceived to be the most practical and preferred embodiment, it is recognized that departures may be made therefrom within the scope of the invention, which is not to be limited to the details disclosed herein but is to be accorded the full scope of the claims so as to embrace any and all equivalent devices and apparatus.

Any discussion of the prior art throughout the specification should in no way be considered as an admission that such prior art is widely known or forms part of the common general knowledge in this field.

In the present specification and claims (if any), the word "comprising" and its derivatives including "comprises" and "comprise" include each of the stated integers but does not exclude the inclusion of one or more further integers.

The invention claimed is:

1. A chin strap when used for improved retention of a motorcycle helmet, said chin strap comprising:

a slip guide attached directly to a first side of the helmet, said slip guide defining a slot therein;

a chin cup; and a length of webbing, wherein a first portion of the webbing passes from the chin cup to the slip guide, wherein the length of webbing is freely movable through the slot, and a second portion of the webbing is adapted to pass from the slip guide to under a chin of a rider and to a second side of the helmet thereby providing two axes of support for retainment of the helmet.

2. The chin strap as in claim 1, wherein the first portion of the webbing is disposed to the second portion of the webbing at an angle of approximately 55 degrees.

3. The chin strap as in claim 1, wherein the chin cup is formed with a first arcuate profile from side to side and a second arcuate profile from top to bottom.

4. The chin strap as in claim 3, wherein the chin cup includes a relief aperture to allow the chin cup to be adapted to conform to the rider's chin.

5. The chin strap as in claim 1, wherein the slip guide is rigidly attached to the helmet in such a way so as to prevent pivotal movement of the slip guide when the helmet is subject to an impact force.

6. A chin strap when used for improved retention of a motorcycle helmet, said chin strap comprising:

a first slip guide attached directly to a first side of the helmet;

a first slot defined in the first slip guide;

a second slip guide attached directly to a second side of the helmet;

a second slot defined in the second slip guide;

a chin cup having a left side and a right side;

a buckle;

a first strap connected at a first end to the left side of the chin cup, wherein the first strap is threaded through the first slot in the first slip guide and is connected at a second end to the buckle;

a second strap connected at a first end to the right side of the chin cup, wherein the second strap is threaded through the second slot in the second slip guide and is connected at a second end to the buckle.

7. The chin strap of claim 6, wherein the first strap moves freely through the first slot in the first slip guide.

8. The chain strap of claim 6, wherein the second length of webbing strap moves freely through the second slot in the second slip guide.

9. The chin strap of claim 6, wherein the buckle joins the second end of the first strap to the second end of the second strap.

10. The chin strap of claim 6, wherein the first slip guide is secured to the first side of the helmet in such a way as to prevent pivotal movement of the first slip guide when the helmet is subject to an impact force.

11. The chin strap of claim 6, wherein the second slip guide is secured to the second side of the helmet in such a way as to prevent pivotal movement of the second slip guide when the helmet is subject to an impact force.

12. A chin strap when used for improved retention of a motorcycle helmet, said chin strap comprising:

a chin cup having a left side and a right side;

a buckle;

a first strap; and a second strap;

wherein the first strap is connected at a first end to the left side of the chin cup, is adapted to be threaded through a first connector mounted on a first side of the helmet, and is connected at a second end to the buckle;

wherein the second strap is connected at a first end to the right side of the chin cup, is adapted to be threaded through a second connector mounted on a second side of the helmet, and is connected at a second end to the buckle;

wherein the chin cup is adapted to be seated on a chin of a rider wearing the helmet, and wherein the buckle is adapted to be seated under the chin of the rider.

13. The chin strap of claim 12, wherein the first connector is a slip guide.

14. The chin strap of claim 13, wherein the second connector is a slip guide.

15. The chin strap of claim 13, wherein the first connector and second connector are fixedly secured to the helmet in such a way as to prevent pivotal movement of the first connector and the second connector relative to the helmet when the helmet is subject to an impact force.

* * * * *